United States Patent [19]

Cobb

[11] 4,019,566

[45] Apr. 26, 1977

[54] AIR CONDITIONING SYSTEM

[75] Inventor: George E. Cobb, Houston, Tex.

[73] Assignee: Carrier Corporation, Syracuse, N.Y.

[22] Filed: Jan. 20, 1976

[21] Appl. No.: 650,659

Related U.S. Application Data

[62] Division of Ser. No. 528,074, Nov. 29, 1974, Pat. No. 3,949,810.

[52] U.S. Cl. ..... 165/2; 98/40 D; 165/30; 165/40; 165/59; 165/96; 236/1 C

[51] Int. Cl.[2] ..... F25B 29/00

[58] Field of Search ..... 236/1 C, 80 B, 149, 236/91; 165/1, 2, 16, 59, 54, 30, 40, 96; 98/40 D, 33 A; 62/259

[56] References Cited

UNITED STATES PATENTS

| | | | |
|---|---|---|---|
| 3,623,543 | 4/1970 | Ostrander | 165/26 |
| 3,664,253 | 5/1972 | Asker | 165/59 |
| 3,867,980 | 2/1975 | Traver | 165/54 |

*Primary Examiner*—C. J. Husar
*Assistant Examiner*—Daniel J. O'Connor
*Attorney, Agent, or Firm*—J. Raymond Curtin; Barry E. Deutsch

[57] ABSTRACT

An air conditioning system for conditioning air in a plurality of enclosed areas in a building. Conditioned air at a relatively cold temperature level is supplied to a terminal for discharge into an area. The quantity of relatively cold temperature air discharged into the area is regulated in accordance with the temperature level therein. A control signal is generated, the magnitude thereof being indicative of the quantity of conditioned air discharged into the area. The magnitude of the control signal is monitored. Warm air supply means is activated when the magnitude of the control signal indicates that the quantity of the relatively cold temperature air being discharged into the area has decreased below a predetermined level.

2 Claims, 3 Drawing Figures

AIR CONDITIONING SYSTEM

This is a divison, of application Ser. No. 528,074 filed Nov. 29, 1974, now U.S. Pat. No. 3,949,810.

BACKGROUND OF THE INVENTION

This invention relates to an air conditioning system for conditioning air in a plurality of areas or spaces in a common enclosure, and more particularly, relates to a control for regulating the operation of said system.

In recent years, many multi-zone buildings, such as schools, offices, apartments and hospitals, have employed central station air conditioning systems to provide conditioned air to regulate the psychometric properties of the air in each of the zones of the building. Very often, each of the spaces are divided into peripheral zones and interior zones. The interior zone of a space generally requires conditioned air at a constant relatively cold temperature to compensate for relatively constant heat producing sources, such as lights, machinery and people. Sometimes, the interior zone supply terminal is designed to deliver a sufficient quantity of relatively cold air so that the entire space may be cooled thereby even during summer conditions.

In such a system, the exterior zone of each space will only require means to provide relatively warm conditioned air during conditions, for example during the winter season, when heat generally flows from the building to the ambient. At times, during winter operation, when the temperature of the ambient is relatively low and there is no sunload to negate transmission losses, the continued discharge of conditioned cold air is entirely unnecessary and undesirable. However, at other times during winter operation, the presence of a sunload will prevent transmission losses of heat to the ambient, thereby requiring the continued discharge of the relatively cold air to compensate for the relatively constant heat producing means, such as lights, machinery, and people. During the latter condition, the continued discharge of relatively warm air is undesirable.

Heretofore, many of the aforedescribed systems have not provided control means to regulate the discharge of both conditioned air streams i.e., relatively warm and cold streams. Very often, only the cold air stream is under the control of quantity regulating means responsive to the temperature in the space. In order to conserve installation costs, designers and installers of systems of the type discussed, have assumed that once the ambient temperature declined to a relatively low level, for example below 50° F, heat would always be required in the areas within the enclosure. Accordingly, when the sunload is relatively strong, even though the ambient temperature is below the setpoint for activation of the warm air supply means, both relatively warm and cold air streams would be simultaneously discharged. As is manifest, the foregoing is not desirable when the conservation of energy and the reduction of operating costs are wanted. Although the use of separate thermostats on the respective cold and warm air supply means might overcome the foregoing problem, this solution would result in an undesirable increase in the installation cost of the system. In addition, the use of two separate thermostats may result in the simultaneous discharge of both hot and cold air streams.

Some system designers have attempted to compensate for solar radiation by employing devices to sense solar rays. Such devices have not always proven to be reliable and in addition, such devices do not take into account the storage effect of the peripheral walls of the building. Thus, although there is always a time lag between the introduction or withdrawal of solar rays and the effect of such rays on transmission gains or losses, solar compensating devices do not take such delay into consideration. Accordingly, the actual requirements of an area or space may be somewhat different than the theoretical requirements as determined by the presence or absence of solar radiation. Furthermore, the use of solar compensators result in undesirable increases in the installation cost of the system.

SUMMARY OF THE INVENTION

It is an object of the present invention to deliver warm air into an area only when the supply of relatively cold air thereinto has fallen below a predetermined level.

It is a further object of the invention to activate warm air supply means when the supply of relatively cold air has fallen below a predetermined minimum level.

It is another object of this invention to prevent simultaneous discharge of relatively warm and relatively cold conditioned air into a single space.

It is yet another object of this invention to utilize a thermostat employed in regulating the quantity of relatively cold air discharged into an area, to activate warm air supply means when warm air is required in a space.

It is yet another object of this invention to utilize a thermostat employed in regulating the quantity of relatively cold air discharged into the area to accommodate the storage effect in the perimeter walls of a building as opposed to utilizing a control responsive directly to solar radiation.

It is still another object of this invention to utilize the controls, normally supplied with air conditioning terminals employed in systems of the type described, to activate warm air supply means when warm air is required in a space.

These and other objects of the present invention are obtained in an air conditioning system for conditioning air in a plurality of enclosed areas in a building. Conditioned air at a relatively cold temperature level is supplied into each of the areas. Control means are provided to regulate the quantity of relatively cold conditioned air discharged into the space in accordance with the temperature level therein. The control means includes means to generate a control signal, the magnitude thereof being indicative of the quantity of conditioned air discharged into the area. The magnitude of the control signal is monitored. When the magnitude of the control signal indicates that the quantity of relatively cold temperature air discharged into the area has decreased below a predetermined level, warm air supply means is activated to provide relatively warm conditioned air into the area.

DESCRIPTION OF THE PREFERRED EMBODIMENT

Figure 1:
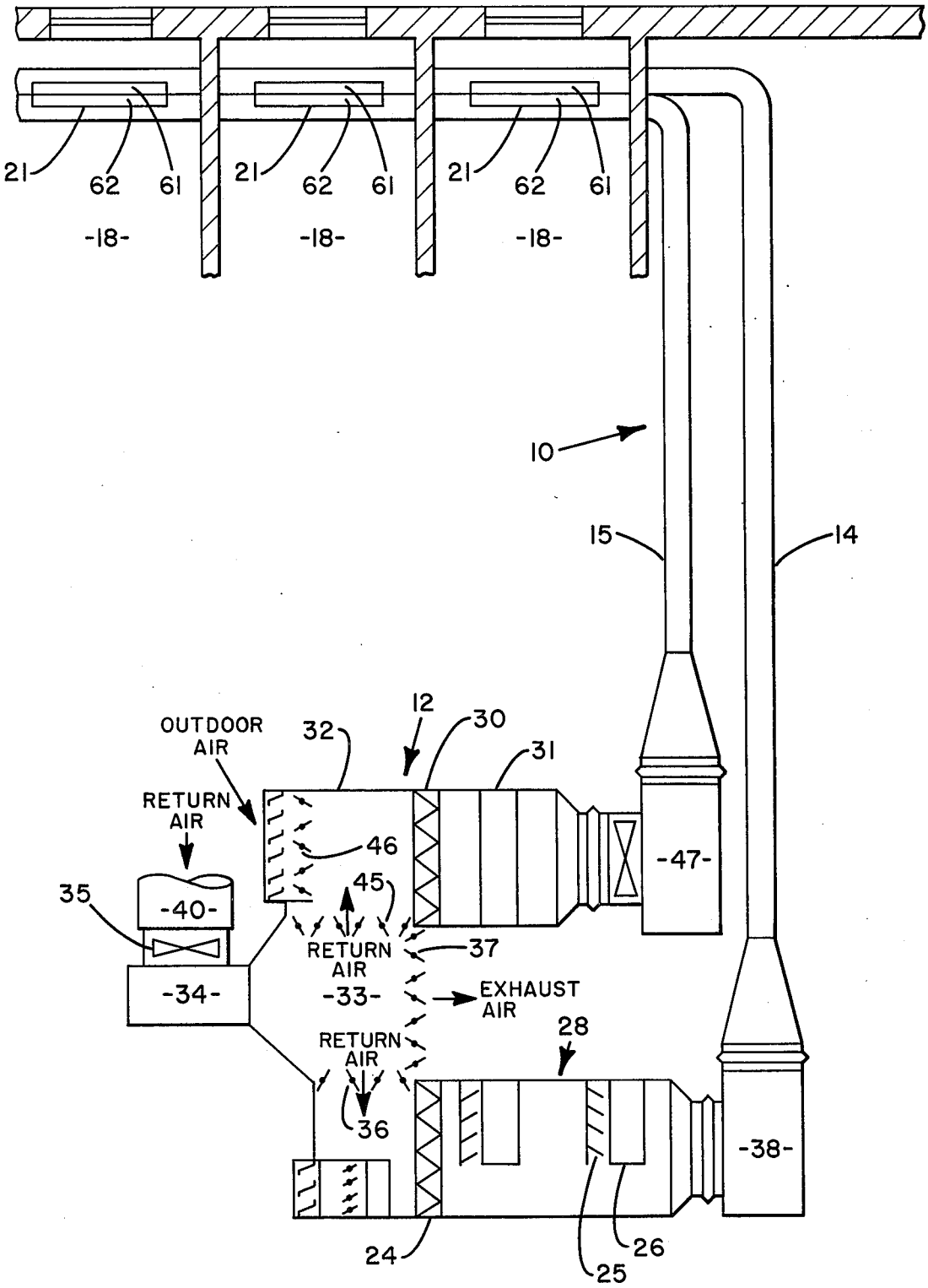
FIG. 1 schematically illustrates an air conditioning system in accordance with the present invention.

Referring now to FIG. 1, there is shown an air conditioning system of the type to which the present invention pertains. Air conditioning system 10, which may be described as a central station type, includes an air conditioning equipment section generally designated by the numeral 12, and a conduit system 14, 15, for conducting conditioned air to the periphery and interior respectively of each of the areas or rooms provided within the common enclosure and served by the system. Equipment section 12 may be located in a basement or on the roof of a building.

For the purpose of this description, the conditioned peripheral air may comprise fresh air or ventilating air drawn from the outdoors, or a mixture of outdoor air and return air treated in section 12 and the conditioned interior air may comprise return air from the areas being conditioned and treated in section 12. Hereinafter, the conditioned interior air may also be referred to as "secondary air." The apparatus for conditioning the peripheral air preferably includes a filter 24 to remove foreign matter entrained in the air and heating coil 126 to elevate the temperature of the air flowing in the peripheral air system or circuit and encased within a suitable housing 28. The passage of peripheral air over coil 26 is regulated by damper 25.

The portion of the central station equipment regulating the secondary air preferably includes a suitable filter 30 to remove foreign matter entrained in the air and a dehumidifier or cooling coil 31 to remove the excess moisture and/or cool the supply air, arranged in series flow relationship and encased within a suitable housing 32. Properly tempered heat exchange media is supplied to coils 26 and 31 via suitable means (not shown).

Housings 28 and 32 are connected by duct 33 with return air exhaust fan 34. The inlet of fan 34 is connected with return air plenum 40 which is connected by suitable means (not shown) with the areas or rooms being served by the air conditioning system. Preferably, inlet air control vanes 35 are provided to vary the flow of air from fan 34. Adjustable members 36 are provided to vary the flow of return air to the peripheral air conditioning apparatus. Exhaust dampers 37 connect exhaust duct 33 with the outdoors. Dampers 37 control the volume of return air discharged to the atmosphere. Housing 28 connects with primary air fan 38. Conduit means 14 conveys air from fan 38 to the areas or rooms being conditioned. An inlet air control vane (not shown) will preferably be employed with fan 38 so that the total volume of air supplied through conduit means 14 may be varied in accordance with actual requirements. Housing 32 is connected to the outlet of return air fan 34. Preferably, adjustable dampers 45 are provided to vary the flow of supply air to the secondary air conditioning apparatus. Adjustable dampers 46 are provided to regulate the flow of outdoor air to the secondary air conditioning apparatus. Conduit means 15 conveys air from fan 47 to the area or rooms being conditioned. Conduit means 14 and 15 provide the peripheral air and secondary air respectively to each air terminal 21 disposed in each of the respective areas or rooms 18.

Figure 2:
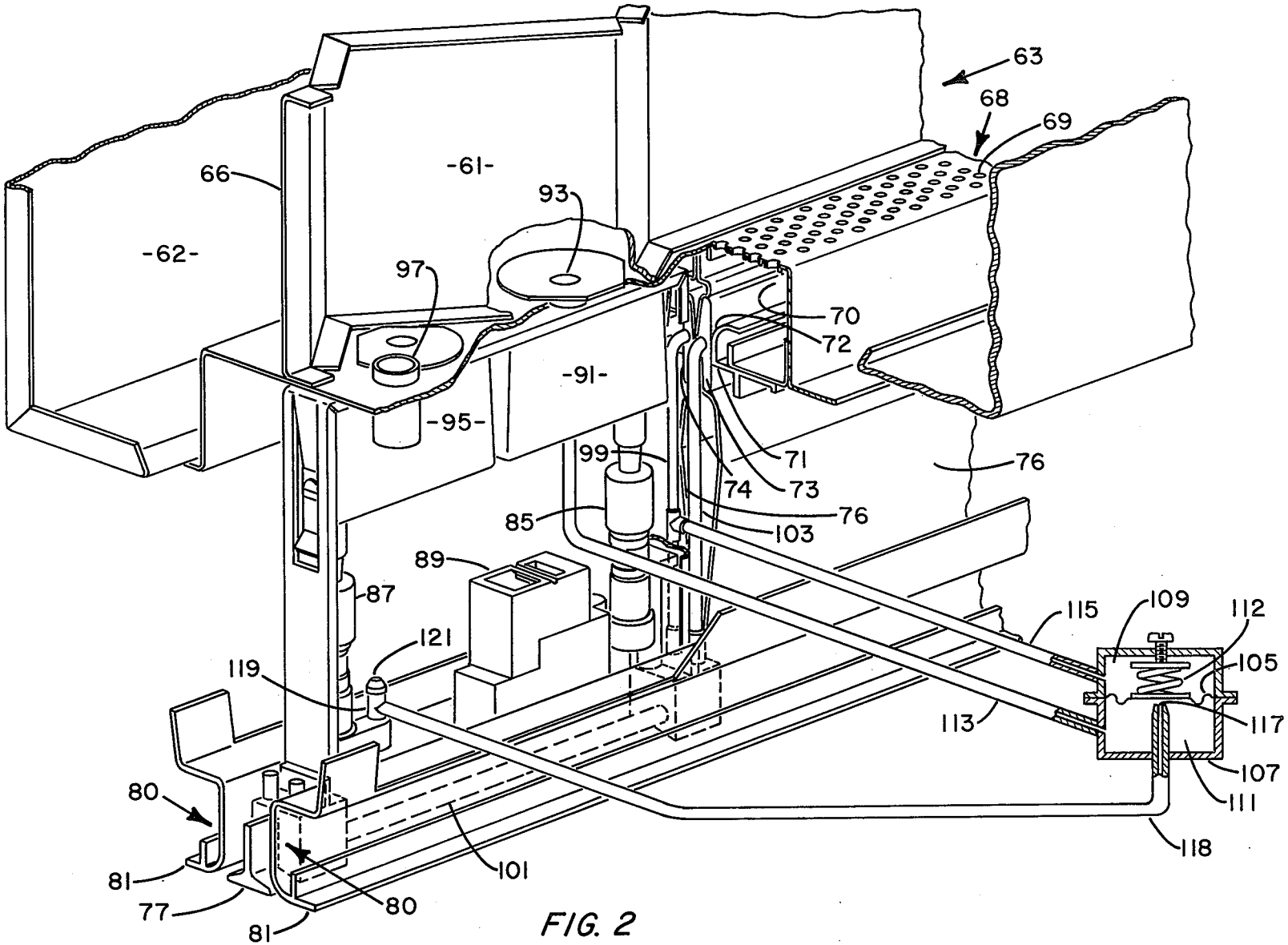
FIG. 2 illustrates a perspective view of an air conditioning terminal with a control therefor, the view also being partially in section and partially in schematic.
Figure 3:
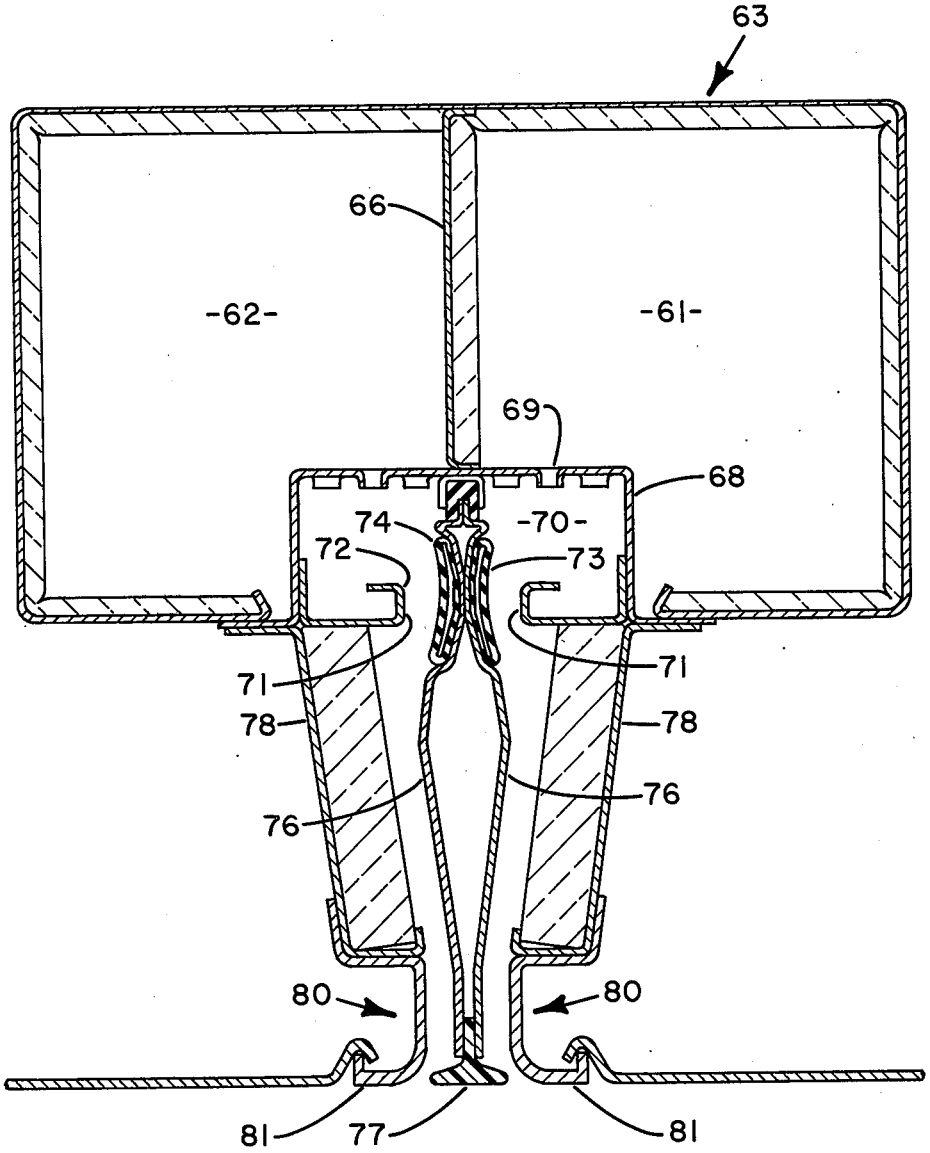
FIG. 3 is a sectional view of an air conditioning terminal illustrated in FIG. 2.

Referring now to FIGS. 2 and 3, there is disclosed a preferred form of terminal and a control therefor in accordance with the present invention. In a typical system of the type to which the present invention relates, a separate terminal, to be described in detail hereinafter, will be disposed in each individual space or room being conditioned. Conduit means 14 and 15 terminate in a plenum section 63 of each terminal. The plenum section is ordinarily lined with a sound absorbing material, such as a glass fiber blanket. A baffle or partition member 66 divides the plenum into first and second portions or sections 61 and 62 for respective connection to conduit means 14 and 15. The baffle thereby maintains the peripheral air separate from the secondary air so that there is no intermixing therebetween. The baffle is preferably insulated to insure that there is no heat transfer between the respective air streams.

An air supply distribution plate 68 having a plurality of openings 69 is provided to evenly distribute the supply air from plenum 63 to distribution chamber 70 which is defined by the top and side walls of distribution plate 68. A portion of the distribution plate is disposed on either side of the baffle so peripheral air moves into a first portion of distribution chamber 70 and secondary air moves into a second portion of the chamber.

The bottom of distribution chamber 70 includes aligned cutoff plates 71 which are provided with a curved surface 72 for engagement by bladders or bellows 73 and 74 to form a damper. By varying the inflation of the bladders, the area of the opening between each of the bladders and cutoff plates may be varied to thereby regulate the quantity of conditioned air discharged into the area or space being conditioned. The manner in which the inflation of the bladders is controlled shall be explained in detail hereinafter.

The bladders are adhesively mounted on a central partition assembly comprising opposed generally convex plates 76. The terminal further includes a diffuser triangle 77 provided in spaced relation between outlet members 80. The plates have a V-shaped recessed area so the bladders are completely recessed within the plates when deflated. This provides a large area between the active walls of the bladders and the cutoff plates for maximum air flow therebetween. Further, the recessed bladder provides a smooth surface on plates 76 to minimize air turbulence.

The damper mechanism is disposed a substantial distance upstream from the discharge openings in the terminal to provide sufficient space therebetween to absorb any noise generated by the damper mechanism. For maximum sound absorption, downwardly extending walls 78 forming air passages in conjunction with plates 76 are lined with a suitable sound absorbing material, such as a glass fiber blanket. Outlet members 80 have outwardly flared portions 81 and are affixed as by welding to walls 78. For a more detailed explanation of the air terminal, reference may be made to copending U.S. Pat. application, Ser. No. 311,076, filed Dec. 1, 1972, now U.S. Pat. No. 3,867,980 in the name of Darwin G. Traver and assigned to the same assignee as the assignee hereof.

The terminal further includes a control section comprising a first regulating device 85, a second regulating device 87, and a thermostat 89. Preferably, regulators 85 and 87 are of the type disclosed in U.S. Pat. No. 3,434,409, issued in the name of Daniel A. Fragnito and thermostat 89 is of the type disclosed in U.S. Pat. No. 3,595,475, issued in the name of Daniel H. Morton. Each of the foregoing patents are assigned to the same assignee as the assignee hereof.

Regulator 85 is responsive to the pressure of the secondary air supplied via conduit means 15 to plenum portion 62. Thermostat 89 is suitably operably connected to regulator 85 for a reason to be more fully described hereinafter. A filter 91 is provided to filter the secondary air passing from plenum section 62 to the regulator via opening 93.

Similarly, a filter 95 is provided to filter the peripheral air passing to regulator 87 from plenum section 61 via opening or orifice 97. Openings 93 and 97 are provided on opposite sides of baffle plate 66. Regulator 85 is suitably joined via line 99 to the bladder regulating the discharge of secondary air from plenum section 62 through the terminal. Similarly, regulator 87 is joined via lines 101 and 103 to the bladder regulating the discharge of peripheral air from plenum section 61. Regulators 85 and 87 are provided to generate a control signal indicative of the pressures of the secondary and peripheral air in the respective plenum sections. The regulators increase the control signals supplied to the bladders to thereby increase the inflation thereof as the air pressure in the plenums increase and operate to decrease the magnitude of the control signal supplied to the bladders as the pressure of the air in the plenum sections decrease. By varying the inflation of the bladders or bellows in accordance with changes in supply air pressure, a relatively constant quantity of air will be discharged from the unit or terminal irrespective of variations in supply air pressure.

As noted before, thermostat 89 is associated with regulator 85. Thermostat 89 is preferably a bleed type thermostat which operates to reduce the pressure signals supplied by regulator 85 to the secondary air bladder as the temperature of the space increases above the design level to thereby decrease the inflation of the bladder and increase the quantity of conditioned air supplied into the space. If the temperature of the space falls below the setpoint temperature, the thermostat bleed closes to increase the magnitude of the control signal supplied to the bladder so it approaches its maximum value as determined by the supply air pressure. The resultant increase in the magnitude of the signal will cause the bladder to inflate to decrease the quantity of secondary air supplied to the space.

The supply of peripheral air, as controlled by regulator 87, is normally substantially constant. The peripheral air temperature is at a relatively warm level to offset transmission losses to the ambient.

There are times during the winter season when solar radiation negates transmission losses and the supply of warm peripheral air is not actually required. Heretofore, it has been the practice to supply the relatively warm air at all times when the ambient temperature falls below a predetermined level, for example 50° F. Thus, once the warm air supply air means was activated, the supply of warm air was maintained at a constant level irrespective of actual requirements in the separate areas.

To overcome the foregoing problem, the present invention includes a pneumatic valve 107. Valve 107 includes a bellows or diaphragm 105 separating the valve into an upper section 109 and a lower section 111. A line 113 communicates lower valve section 111 with plenum section 62 so that the lower surface of diaphragm 105 is responsive to the pressure of the air in the plenum section. A conduit 115 communicates upper section 109 with a portion of the system that is substantially at the pressure of the bladder or bellows controlling the discharge of secondary air, for example line 99. Accordingly, the upper surface of diaphragm 105 is subjected to bladder pressure. Control valve 107 further includes a spring 112 or similar means to provide an additional force on the upper surface of diaphragm 105. The forces developed on the upper surface of the diaphragm maintain the diaphragm in contact with an ingress opening 117 of line 118 except when the force developed on the lower surface of the diaphragm exceeds the total force developed on the top surface thereof.

Line 118 communicates lower valve section 111 to a connection point 119 in valve 87. Connection point 119 is located between bleed opening 121 and a connection point for the air supplied to the inflatable bellows via line 101.

OPERATION

Assume the system is operating during winter conditions. Accordingly, the peripheral air supplied via conduit means 14 to plenum section 61 is at a relatively warm temperature level to normally compensate for transmission losses to the ambient. The supply of secondary air through conduit means 15 to plenum section 62 is at a relatively cold level to offset heat developed by people, machines and lights.

The quantity of secondary air discharged into the area or space being conditioned is under the control of both regulator 85 and thermostat 89, whereby the quantity of air discharged is varied in accordance with the temperature demands of the space. Even though the ambient temperature is at a relatively low level, there are times when transmission losses will be compensated for by solar radiation and thus the discharge of relatively warm peripheral air is not required. Conversely, there are times, for example during extreme cloud cover, when transmission losses to the ambient will not be compensated for by solar radiation and thus the discharge of relatively warm air is required.

When solar radiation is negating transmission losses, the continued discharge of relatively warm air raises the temperature level in the space so thermostat 89, in conjunction with regulator 85, operates to reduce the pressure signal supplied to the bladder regulating the flow of secondary air into the space. The bladder is thus deflated as a result of the reduced pressure signal to thereby permit a greater quantity of relatively cold secondary air to be discharged into the area.

As noted before, line 115 communicates the pressure signal supplied to the secondary air control bladder with the top section 109 of valve 107. As the magnitude of the pressure signal is decreased, as a result of the requirement for a greater quantity of secondary air in the space the air signal provided to the lower section 111 of the valve, via line 113, causes diaphragm 105 to lift to thereby open line 118 to permit an air signal to pass from section 111 to connection point 119.

The control signal passing through line 118 to connection point 119 of regulator valve 87 results in an increase in the magnitude of the pressure signal communicated to the peripheral air control bladder. This is as a result of the control signal, provided via line 118, preventing the bleeding of air to the atmosphere via opening 121. In effect, the control signal develops a "back pressure" which forces the air flowing through regulator 87 to pass to the peripheral air bladder via lines 101 and 103. The bladder is inflated to its fullest extent to thereby substantially terminate the discharge of warm air into the area. This stoppage of warm air flow into the area as the temperature therein is increased minimizes operating costs and improves overall efficiency of the system.

As transmission losses to the ambient increase, the temperature level of the area being conditioned decreases. Thermostat 89, in conjunction with regulator 85 increase the magnitude of the pressure signal supplied to the secondary air bladder to increase the inflation thereof to thereby decrease the quantity of relatively warm secondary air supplied to the space.

Essentially, as the bladder pressure increases to decrease the quantity of conditioned secondary air discharged, the air pressure in sections 109 and 111 of valve 107 approaches equality. Accordingly, diaphragm 105 is forced downwardly due to the greater force acting on the top face thereof by the additive forces produced by the air pressure and the spring, to eliminate the flow of air through conduit 118. The foregoing events result in a reduction in the "back pressure" developed at connection point 119 of regulator 87. This permits a greater quantity of the warm air passing through regulator 87 to bleed to the atmosphere via orifice 121 to decrease the magnitude of the peripheral air pressure signal supplied to the air control bladder. The foregoing will result in deflation of the bladder thereby permitting relatively warm peripheral air to be supplied to the space being conditioned. The supply of warm air will be under the control of constant volume regulator 87.

When the air conditioning system is functioning during summer conditions, the peripheral system will be rendered inoperative.

The present invention permits a single thermostat, to not only regulate the quantity of relatively cold secondary air supplied to a space, but in addition, to generate a control signal whereby relatively warm peripheral air is supplied to a space only when required. The control is effective in reducing installation costs and energy requirements of an air conditioning system of the type described.

It should be understood that the warm air supply means of the type disclosed may be replaced by other types of warm air supply terminals. For example, in lieu of the warm air being supplied from a central station through a ceiling terminal, the warm air supply means may comprise an electric resistance heater whereby the control signal generated by regulator 85 and thermostat 89 is supplied to a pneumatic switch to activate the electric resistance heater in accordance with the magnitude of the control signal.

The present invention utilizes a pair of pressure regulators and a thermostat which are standard components of the terminal and, by the addition of a relatively inexpensive pneumatic relay, provides an extremely efficient control.

While a preferred embodiment of the present invention has been described and illustrated, the invention should not be limited thereto, but may be otherwise embodied within the scope of the following claims.

I claim:

1. A method of operating an air conditioning system for conditioning air in a plurality of enclosed areas in a building comprising the steps of:

delivering a stream of air conditioned to a relatively constant cold temperature level to a terminal provided in each of the areas;

regulating the quantity of relatively cold conditioned air discharged into the area in accordance with the temperature level therein;

generating a control signal, the magnitude thereof varying in accordance with the quantity of constant temperature conditioned air supplied to the area;

monitoring the magnitude of the control signal; and activating a warm air supply terminal when the magnitude of the control signal indicates that the quantity of constant temperature relatively cold air discharged into the area has decreased below a predetermined level.

2. A method of operating an air conditioning system in accordance with claim 1 wherein said control signal is an air pressure signal, the magnitude thereof being varied by operation of a thermostat responsive to temperature conditions in said area.

* * * * *